US006957766B2

(12) United States Patent
Das et al.

(10) Patent No.: US 6,957,766 B2
(45) Date of Patent: Oct. 25, 2005

(54) ENVELOPE WITH ENHANCED OPENING CAPABILITIES AND METHOD THEREFOR

(75) Inventors: Pradeep K. Das, Bethel, CT (US); David W. Spencer, Avon, CT (US); Ronald P. Sansone, Weston, CT (US)

(73) Assignee: Pitney Bowes Inc., Stamford, CT (US)

( * ) Notice: Subject to any disclaimer, the term of this patent is extended or adjusted under 35 U.S.C. 154(b) by 201 days.

(21) Appl. No.: 10/608,963

(22) Filed: Jun. 27, 2003

(65) Prior Publication Data

US 2004/0261549 A1 Dec. 30, 2004

(51) Int. Cl.[7] ..... B65D 27/32; B65D 27/00; G01M 19/00

(52) U.S. Cl. ..... 229/307; 73/865.9

(58) Field of Search ..... 229/307–308, 229/313, 316; 73/865.9

(56) References Cited

U.S. PATENT DOCUMENTS

| | | | | |
|---|---|---|---|---|
| 2,142,843 | A * | 1/1939 | Harris | 40/771 |
| 2,964,233 | A * | 12/1960 | McFarland | 229/302 |
| 3,199,769 | A * | 8/1965 | Hillman, II | 229/307 X |
| 3,420,432 | A * | 1/1969 | Cooper | 229/313 X |
| 3,788,539 | A * | 1/1974 | Vjecsner | 229/77 |
| 3,970,130 | A * | 7/1976 | Casey | 150/149 |
| 4,011,985 | A * | 3/1977 | Simson | 229/68.1 |
| 4,129,214 | A * | 12/1978 | Gendron | 229/313 |
| 5,356,022 | A * | 10/1994 | Tipps | 229/117.3 |
| 5,713,511 | A * | 2/1998 | Diamond | 229/302 |
| 6,343,736 | B1 | 2/2002 | Kim | 229/303 |
| 6,412,687 | B1 | 7/2002 | Steitz | 229/305 |
| 6,418,648 | B1 | 7/2002 | Hollingsworth et al. | 40/124.14 |
| 6,491,213 | B2 | 12/2002 | Purcell | 229/309 |
| 2002/0164088 | A1 * | 11/2002 | Collins | 383/10 |
| 2003/0136203 | A1 * | 7/2003 | Yoon | 73/864.33 |
| 2003/0140015 | A1 * | 7/2003 | Applebaum | 229/307 X |

FOREIGN PATENT DOCUMENTS

| | | | | |
|---|---|---|---|---|
| EP | 447894 | A1 * | 9/1991 | B65D 27/34 |

* cited by examiner

*Primary Examiner*—Thomas P. Noland
(74) *Attorney, Agent, or Firm*—Michael J. Cummings; Charles R. Malandra, Jr.; Angelo N. Chaolas

(57) ABSTRACT

A method and apparatus for an envelope that includes a first portion of material, forming a first surface, a second portion of material, forming a second surface, the second portion being connected to the first portion at selected regions and a third portion of material, connected to the first portion and adapted to contact the second portion, the third portion having a flap that is removable to provide access to an aperture. The flap is fabricated from the same material as the third portion of material. A perforation located in proximity to the flap and adapted to facilitate opening of the envelope.

11 Claims, 2 Drawing Sheets

ENVELOPE WITH ENHANCED OPENING CAPABILITIES AND METHOD THEREFOR

FIELD OF THE INVENTION

The present invention relates to an envelope that has a flap to facilitate opening the envelope. More particularly, the flap of the envelope permits a user to gain access to an upper edge that is perforated, which provides an enhanced way to open the envelope.

BACKGROUND DISCUSSION

Conventional envelopes may be difficult to open, especially without a letter opener, since once sealed, the user typically must rip or tear the envelope to open it. These actions can be awkward and can result in minor cuts and/or abrasions to the fingers and hands of the person tearing the envelope open.

One conventional envelope design is disclosed in U.S. Pat. No. 6,343,736, issued to Kim, entitled, "Reusable Mailing Envelope With Tear-Strip Opening Device". This patent relates to a reusable envelope with a front address panel and a rear panel joined along three edges to form a pocket with an open top. A first extended sealing flap joined to the top edge of the address panel is provided with a tear strip formed by a line of perforations extending across the top edge of the envelope and through the flap.

A second sealing flap is provided which is foldably connected to the top edge of the rear panel and is initially either folded and retained inside the envelope pocket or against the exterior of the rear panel for the first mailing, and is folded over and onto the first panel for the second use. The second flap has an adhesive area securing means for sealing the envelope when the flap is positioned on the address panel for a further mailing. The address panel is provided with an area is for postage indicia and, is optionally provided with a first return address area adjacent the top edge of the address panel. The address panel optionally includes a second return address area located adjacent the bottom edge of the address panel and another area for applying postage. The second sealing flap is sized to cover at least the first return address area and first postage area and, optionally, the first address area, when the second sealing flap is folded over and sealed to the address panel, and can also be pre-printed by the originator with return address and bulk mailing indicia.

Another conventional envelope is disclosed in U.S. Pat. No. 6,418,648, issued to Hollingsworth et al., entitled, "Prepaid Card in a Pull Out Envelope". This patent relates to a fold out, two panel card having a pop-out portion supporting a prepaid card. The two panel card includes an outer two panel portion and an inner two panel portion in registry with the outer portion. The inner two panel portion further includes the pop-out portion supporting the prepaid card. The pop-out portion comprises a first and second pop-out panels extending from the respective panels of the inner two panel portion. The prepaid card is secured to a major portion of one of the pop-out panels and a tongue cut out of the other pop-out panel. The pop-out portion and prepaid card of the inner two panel portion are received inside the outer two panel portion when the inner and outer two panel portions, in registry with each other, are folded together. Unfolding the in registry two panel portions causes the pop-out portion and prepaid card to lie flat, co-planar with the unfolded panels, wherein the longitudinal axis of the prepaid card is parallel to the longitudinal axis of the two panel card.

Another conventional envelope is disclosed in U.S. Pat. No. 6,491,213, issued to Purcell, entitled, "Easy Open Envelope". This patent relates to an envelope that has a tear strip that functions as an efficient opening means for access to the envelope contents.

What is needed to advance the state of the art is an envelope that is easy to open and can be used to contain the contents after the envelope has been opened.

SUUMARY OF THE INVENTION

One embodiment of the present invention is directed to an envelope that includes a first portion of material, forming a first surface and a second portion of material, forming a second surface. The second portion is connected to the first portion at selected regions. A third portion of material is connected to the first portion and is adapted to contact the second portion. The third portion has an aperture exposed to an exterior surface of the third portion and a flap that covers the aperture on an interior surface of the third portion.

Another embodiment of the present invention is directed to the envelope described above wherein the flap is fabricated from the same material as the third portion.

Yet another embodiment of the present invention is directed to envelope as described above and also including a probe that is adapted to detect the contents of the envelope.

DETAILED DESCRIPTION

The present invention facilitates opening a letter without a letter opener. The opened envelope is suitable to store the contents of the envelope. The present invention is particularly useful for mass mailings and mailing advertisement information, since it is beneficial to the sender to reduce as many barriers as possible.

The present invention is an envelope that has a flap portion located on the back side of the envelope to enable a person opening the envelope to gain access to the top edge of the envelope, which has a perforation. The perforation provides a neat manner for opening the envelope.

The envelope of the present invention has a cut out area on a back surface of the envelope, which provides a user access to a small flap. The flap is positioned such that when pulled, it rips the envelope (by interacting with perforations) up to a perforated edge. The perforated edge may be produced by micro-perforation. The cut out area is covered on the inside of the envelope with a piece of paper or material to cover the cutout hole. The material used to cover the cutout area is typically made from the same material as the envelope, which is for example, paper or Tyvek™ or other suitable material.

Figure 1:
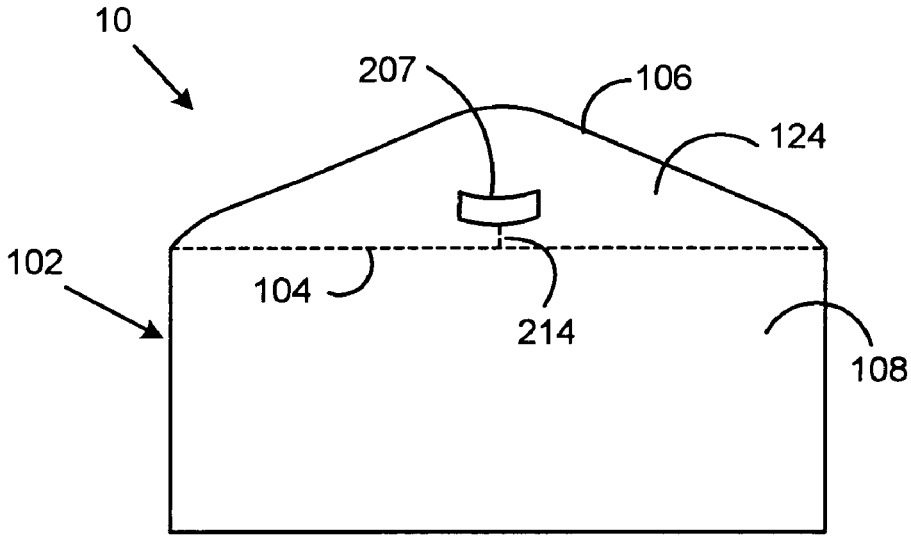
FIG. 1 shows a front view of an envelope according to the present invention.

FIG. 1 shows a front view 10 of an envelope 102 according to the present invention. As shown in FIG. 1, the envelope 102 has a first portion 108, which forms a first surface. This surface is typically used to print recipient address data, postal indicia, and in some instances, return address data and/or slogan or advertising data. Fold-over portion 106 is also shown as well as perforations 104. Perforations 104 are typically proximate to an upper portion of portion 108. Once the envelope 102 has been opened, since perforations 104 facilitated the opening process, the tear is controlled and the envelope 102 may be used to store or contain the contents of the envelope 102.

Figure 2:
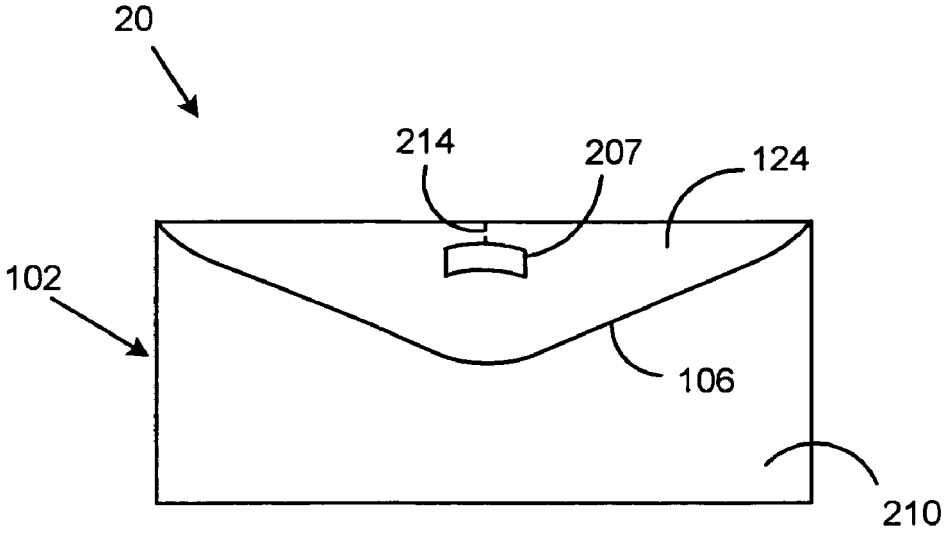
FIG. 2 shows a back view of the envelope according to the present invention.

FIG. 2 shows a back view 20 of the envelope 102 according to the present invention. Fold-over portion 106, also shown in FIG. 1, has an exterior surface 124, which is planar to back surface 210 when the fold-over portion 106 is folded down to seal the envelope. Back surface 210 is formed from material constituting the rear or back portion of the envelope 102. An aperture 207 is connected to perforations 214. Typically, perforations 214 are in contact with perforations located along an upper surface of the envelope 102, which are shown in FIG. 1 as perforations 104.

The aperture, or cutout 207 is typically between 1 and 5 centimeters in the horizontal direction (as oriented in FIG. 2) and between 0.2 and 2.0 centimeters in the vertical direction (as oriented in FIG. 2). However, virtually any dimensions that enable a user to access perforations 214 may be used. The aperture 207 is exposed to exterior surface 124 of fold-over portion 106.

As shown in FIG. 2, the cutout 207 permits a user to place a finger, or other utensil, into the aperture and access perforations 214. Perforations 214 may be connected to perforations along an upper surface of the envelope 102.

Figure 3:
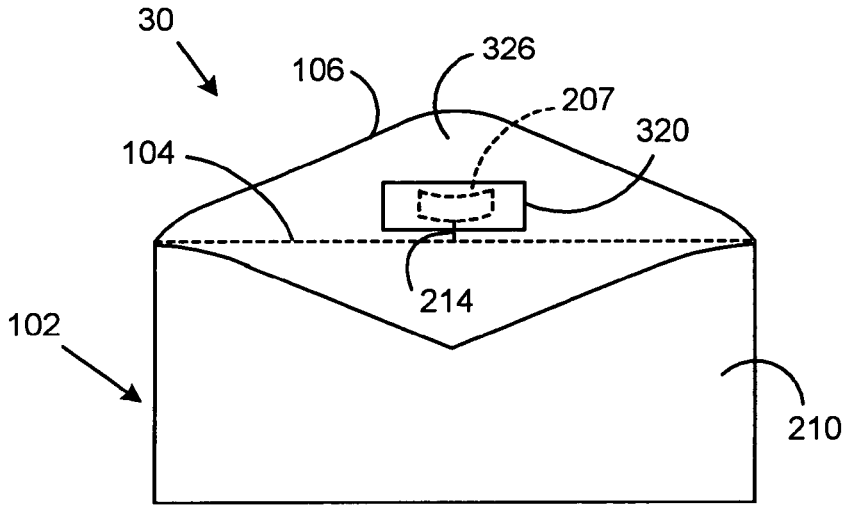
FIG. 3 shows an inside view of the envelope according to the present invention.

FIG. 3 shows an inside view 30 of the envelope 102 according to the present invention. Surface 315 is shown as well as fold-over portion 106, which has interior surface 326 on which a flap 320 is mounted. Flap 320 covers aperture 207 such that a user may insert a finger or other utensil into aperture 207 and not disturb contents in the envelope.

The dimensions of the flap 320 are typically slightly larger than the aperture which the flap 320 is covering. This prevents moisture and other contaminants from entering the envelope 102 through aperture 207. Perforations 214 are accessed from aperture 207 and are connected to perforations 104.

Figure 4:
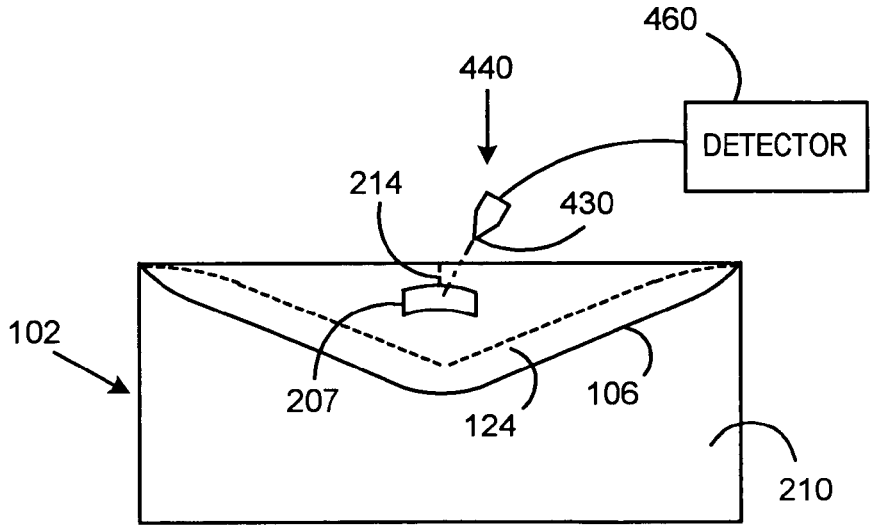
FIG. 4 shows an envelope of the present invention used in conjunction with a probe.

FIG. 4 shows the envelope of the present invention 102 used in conjunction with a probe device 440. The envelope components described in relation to FIG. 2 will not be discussed in relation to FIG. 4. The probe device 440, with tip 430, typically has dimensions suitable for insertion into the envelope 102 via aperture 207. The probe 440 has a tip 430 that can penetrate flap 320 to determine whether the envelope contains illegal, hazardous, toxic or other contaminant material, such as anthrax or similar material.

The probe device 440 is suitably coupled to a detector 460 that can take samples from the envelope 102. The detector may perform analysis at the location or store the sample for analysis at a later time. The flap 320 reduces the possibility that toxic or hazardous material will escape from the envelope 102 while the probe 440 is inserted into the envelope 102.

The flap, described in relation to FIG. 3, may be a material that permits a probe tip to be inserted multiple times without tearing or ripping the material. For example, the flap material may be a polymer, resin or rubber material to form a permeable membrane.

While the applicants have attempted to describe all of the possible embodiments that applicant has foreseen, there may be unforeseeable and insubstantial modifications that remain as equivalent.

What is claimed is:

1. An envelope comprising:

a first portion of material, forming a first surface;

a second portion of material, forming a second surface, the second portion being connected to the first portion at selected regions; and a third portion of material, connected to the first portion and adapted to contact the second portion, the third portion having an aperture exposed to an exterior surface of the third portion and a flap that covers the aperture on an interior surface of the third portion.

2. The apparatus as claimed in claim 1, wherein the flap is fabricated from the same material as the third portion of material.

3. The apparatus as claimed in claim 1, further comprising:

a first perforation located in proximity to the aperture and adapted to facilitate opening of the envelope.

4. The apparatus as claimed in claim 3, further comprising:

a second perforation located along an upper edge of the envelope.

5. The apparatus as claimed in claim 1, further comprising:

a probe device adapted for insertion into the aperture.

6. The apparatus as claimed in claim 5, wherein the probe is adapted to detect the contents of the envelope.

7. A method for opening an envelope comprising:

providing a first portion of material, forming a first surface;

providing a second portion of material, forming a second surface, the second portion being connected to the first portion at selected regions; and providing a third portion of material, connected to the first portion and adapted to contact the second portion, the third portion having an aperture exposed to an exterior surface of the third portion and a flap that covers the aperture on an interior surface of the third portion.

8. The method as claimed in claim 7, further comprising:

fabricating the flap from the same material as the third portion of material.

9. The method as claimed in claim 7, further comprising:

perforating a portion of the envelope in proximity to the aperture to facilitate opening of the envelope.

10. The method as claim 9, further comprising:

perforating a portion of the envelope along an upper edge of the envelope.

11. The method as claimed in claim 7, further comprising:

inserting a probe device into the envelope via the aperture.

* * * * *